United States Patent [19]

Vallak

[11] Patent Number: 4,600,560

[45] Date of Patent: Jul. 15, 1986

[54] PROCESS FOR THERMAL INSULATION OF THE SURFACE OF A MOLTEN MASS OF STEEL AND THERMALLY INSULATING BOARD USED AS A COVER PLATE FOR CARRYING OUT SAID PROCESS

[75] Inventor: Hannes Vallak, Geneva, Switzerland

[73] Assignee: International Ferrox Co., Establishment, Vaduz, Liechtenstein

[21] Appl. No.: 672,251

[22] PCT Filed: Mar. 6, 1984

[86] PCT No.: PCT/EP84/00063

§ 371 Date: Nov. 7, 1984

§ 102(e) Date: Nov. 7, 1984

[87] PCT Pub. No.: WO84/03460

PCT Pub. Date: Sep. 13, 1984

[30] Foreign Application Priority Data

Mar. 8, 1983 [SE] Sweden ..... 8301244

[51] Int. Cl.[4] ..... B01J 11/18; B22D 7/10

[52] U.S. Cl. ..... 422/41; 106/DIG. 2; 164/123; 428/446; 501/83

[58] Field of Search ..... 422/41; 164/123; 501/80, 83; 428/446; 106/DIG. 2

[56] References Cited

U.S. PATENT DOCUMENTS

| | | | |
|---|---|---|---|
| 4,106,905 | 8/1978 | Schmitt et al. | 422/41 |
| 4,159,302 | 6/1979 | Greve et al. | 106/DIG. 2 |
| 4,440,575 | 4/1984 | Daussan et al. | 164/123 |

FOREIGN PATENT DOCUMENTS

| | | |
|---|---|---|
| 1463895 | 12/1966 | France . |
| 2458521 | 1/1981 | France . |

*Primary Examiner*—David L. Lacey
*Assistant Examiner*—Titus B. Ledbetter, Jr.
*Attorney, Agent, or Firm*—Cushman, Darby & Cushman

[57] ABSTRACT

A process of using a thermally insulating board, made of a homogeneous mixture of expanded perlite particles and cellulosic and/or mineral and/or ceramic fibers, bonded together, comprising placing on the surface of a molten steel mass, in direct contact with the surface, so as to cover substantially all the surface. According to a preferred embodiment, the board consists of 51 to 80% by weight of expanded perlite particles, 15 to 39% by weight of cellulosic and/or mineral fibers and 5 to 10% by weight of binder.

1 Claim, No Drawings

PROCESS FOR THERMAL INSULATION OF THE SURFACE OF A MOLTEN MASS OF STEEL AND THERMALLY INSULATING BOARD USED AS A COVER PLATE FOR CARRYING OUT SAID PROCESS

The present invention relates to a process for thermally insulating of the surface of a molten mass of steel which is contained, for instance, in a ladle or a tundish used in the steel manufacture. The invention also concerns a thermally insulating board suitable for use as a cover plate for carrying out this process.

As is well known, a tundish is generally used, in the steel manufacture, in carrying out continuous casting, such tundish being interposed between the ladle and the moulds of the continuous casting section, in order to maintain a constant ferrostatic pressure in the mass of molten metal which is to be cast. Owing to the relatively long duration of the casting operation, it is necessary to decrease the heat losses from the steel surface and to limit the oxidation of this surface which is caused by its contact with the atmosphere while the molten steel mass is at elevated temperature.

According to the prior art, the insulating of the molten steel surface is made using pulverulent insulating materials to form an insulating layer over the steel surface. However, the insulating methods using pulverulent materials suffer the drawbacks that the insulating effects which are achieved are not very effective and that dust is evolved.

The aim of the present invention is to increase the thermal insulating effect as well as the efficiency of the protection of the molten steel surface against oxidation, and to eliminate the problems caused by the evolution of dust.

To that effect, the process according to the invention is characterized in that a thermally insulating board, made of an homogeneous mixture of expanded perlite particles and cellulosic and/or mineral and/or ceramic fibers, said particles and said fibers being bonded together by at least one binder, is placed on the surface of the molten steel mass, in direct contact with this surface, so as to cover substantially all this surface.

According to a preferred embodiment, the board consists of 51 to 80% by weight of expanded perlite particles, 15 to 39% by weight of cellulosic and/or mineral and/or ceramic fibers and 5 to 10% by weight of binder.

By way of binder, use can be made of known materials such as bituminous materials, for example asphalt, used either alone or in combination with starch or synthetic resins, in particular phenolic resins. Colloidal silica solutions can also be used by way of binder.

The density of the board is preferably of from 0.14 to 0.26 kg/dm$^3$. The board thickness is preferably of from 10 to 200 mm.

I claim:

1. A process of thermally insulating a surface of a molten mass of steel which is contained in a foundry ladle or a tundish, comprising: placing a thermally insulating board on the surface of the molten mass of steel, in direct contact with the surface thereof, so as to cover the surface, said board being made of a homogeneous mixture of expanded perlite particles and at least one fiber selected from the group consisting of cellulosic, mineral and ceramic fibers, said particles and said fibers being bonded together by at least one fire proof binder.

* * * * *